United States Patent [19]

Sullivan

[11] Patent Number: 4,590,488

[45] Date of Patent: May 20, 1986

[54] CIRCUIT FOR CONTROLLING ENERGIZATION OF THERMAL PRINT HEAD

[75] Inventor: Michael J. Sullivan, Portsmouth, R.I.

[73] Assignee: Astro-Med, Inc., West Warwick, R.I.

[21] Appl. No.: 737,921

[22] Filed: May 28, 1985

[51] Int. Cl.[4] ..... B41J 3/20

[52] U.S. Cl. ..... 346/76 PH; 400/120

[58] Field of Search ..... 346/76 R, 76 PH; 400/120; 250/317.1, 318; 219/216 PH, 494; 364/519

[56] References Cited

U.S. PATENT DOCUMENTS 4,113,391 9/1978 Minowa ..... 346/76 PH

*Primary Examiner*—A. Evans

*Attorney, Agent, or Firm*—Salter & Michaelson

[57] ABSTRACT

An electrical circuit for controlling the energization of thermal print head elements on a thermal print head. The circuit is responsive to the overall temperature of a thermal print head for varying the amounts of energy supplied the print head elements thereof so that markings of substantially uniform darkness can be produced on thermally sensitive sheets regardless of the overall head temperature. The circuit is operative in response to a start signal for producing a predetermined number of sequential pulses of substantially uniform duration during a printing cycle to sequentially energize different groups of print head elements at different times during the cycle. The voltage level of the pulses in the cycles is maintained substantially constant, whereas the duration of the pulses in different cycles is varied to vary the amounts of energy supplied to the print head elements.

2 Claims, 3 Drawing Figures

CIRCUIT FOR CONTROLLING ENERGIZATION OF THERMAL PRINT HEAD

BACKGROUND AND SUMMARY OF THE INVENTION

The instant invention relates to thermal printing and more particularly to a circuit for energizing a plurality of thermal print head elements on a thermal print head to effect printing on a thermally responsive sheet.

Thermal printing, wherein styli or print heads are selectively heated to produce markings on thermally sensitive sheets is well known and has been found to be effective for a wide variety of printing applications. In this regard, it is also well known that thermal print heads comprising large numbers of individually selectively energizable print head elements can be effectively utilized for producing well defined characters on thermally responsive sheets in thermal printing applications. Generally, thermal print heads of this type have comprised a body made of an electrically insulating material, such as glass or porcelain, and a plurality of print head elements which are disposed in closely spaced, but electrically insulated relation in a predetermined array on a printing surface of the body. For use of a thermal print head of this type, each of the print head elements thereof is electrically connected to energizing circuitry, and switch means is provided for each print head element so that each element is selectively energizable to produce a localized heated spot on the print head. Accordingly, a print head of this type can be used to produce images on a thermally sensitive sheet by selectively energizing various different combinations of elements on the print head for short periods of time to produce markings on the thermally sensitive sheet as the sheet is passed beneath the print head. Obviously, in this type of operation, the sizes of the individual markings produced on a thermally sensitive sheet depend on the sizes of the print head elements on the print head, the speed of the paper as it is passed beneath the print head, and the durations of the pulses during which the print head elements are energized. On the other hand, the darkness and uniformity of an image produced by a thermal print head are determined by the temperatures of the print head elements which, in turn, are related to the amounts of energy supplied to the print head elements when they are energized during the short pulses. However, it has been found that when a thermal print head comprising a number of print head elements is used in a continuous or prolonged printing operation, the overall temperature of the head can tend to gradually rise so that the print head elements require less energy to reach the same temperatures. As a result, if the amount of energy supplied to the print head elements of a print head is not decreased as the overall temperature of the print head increases, the images produced by the head can become increasingly dark and the sheet can even be burned by the head. Further, in this regard, the tendency of a thermal print head to build up heat is aggravated by the fact that the body portion of a print head must be made of an electrically insulating material, and as a rule, materials of this type inherently have relatively poor properties of thermal conductivity. In any event, as a result of these factors it has generally been found that it is necessary to provide some means for controlling the amount of energy which is supplied to the print head elements of a thermal print head as the temperature of the head is increased in order to produce images of consistent quality and darkness.

In addition to the above problem regarding heat buildup in thermal print heads, it has also been found that it is desirable to sequentially energize different groups of the print head elements on a thermal print head at different times during a printing cycle rather than to energize all of the specified elements on a print head at one particular time. In this regard, many thermal print heads contain large numbers of print head elements (up to 4,000 or more on large heads) and as a result, if all or a large number of the elements of a relatively large print head are energized at one time, a large current surge is produced which can cause a significant amount of interference in other circuitry in the general area. Accordingly, to overcome this problem, circuits have been developed which sequentially energize different groups of print head elements on a print head to different times during short printing cycles rather than energizing all of the selected elements at one time.

Accordingly, it has been found that in order for a thermal print head to be effective, it should be utilized in combination with circuitry which is operative for producing sequential pulses during a printing cycle and which is also operative for reducing the amount of energy which is supplied to the print head elements of a print head as the overall temperature of the print head is increased. Heretofore, this problem has been solved by providing circuitry which is operative for producing sequential pulses of uniform duration during a printing cycle, wherein the voltage applied to the print head elements during the pulses is reduced as the temperature of the print head is increased. However, it has been found that circuitry of this type is relatively complex and expensive, and therefore it has been found to be less than entirely satisfactory.

The instant invention provides a novel circuit which is operative for producing a plurality of sequential pulses during a printing cycle for energizing sequential groups of print head elements wherein the energy supplied to the printed elements is reduced as the temperature of the print head is increased. In this regard, however, the circuit of the instant invention is operative for controlling the energy supplied to the print head elements during the pulses by varying the durations of the pulses which are applied to the print head elements during a printing cycle rather than varying the voltage levels of the pulses. It has been found that this provides an effective means for controlling the amounts of energy supplied to the print head elements of a print head. Further, it has been found that the circuit of the instant invention is substantially simpler than the heretofore known circuits which have controlled the amounts of energy supplied to the print head elements of thermal print heads by controlling the amounts of voltage applied to the elements during sequential pulses and that therefore the circuit is adapted for substantially less expensive constructions than the heretofore available circuits for energizing print head elements.

The circuit of the instant invention which is operative for energizing a plurality of thermal print head elements on a thermal print head comprises first signal generating means for generating a signal having a frequency which is proportional to the value of a predetermined parameter, such as the temperature of the print head, second signal generating means which communicates with the first signal generating means and which is actuatable for generating a predetermined number of sequential pulses of substantially uniform duration, wherein the duration of the sequential pulses from the second signal generating means is proportional to the frequency of the signals from the first signal generating means, and means for actuating the second signal generating means in response to an input signal to the circuit and for deactuating the second signal generating means after a predetermined number of sequential pulses has been produced therefrom. Hence, when the first signal generating means is connected to a temperature sensing element on a print head, and the second signal generating means is connected to actuating or gating circuitry for the print head elements on the print head, each time an input signal is received by the actuating means, the circuit produces a cycle of pulses of substantially uniform duration and different groups of print head elements on the print head, are energized at different times during the cycle, but the duration of pulses in a particular cycle is proportional to the temperature of the print head as sensed by the sensing means. In other words, although the durations of all of the pulses in a particular cycle are substantially uniform, the durations of the pulses in different cycles vary in proportion to the temperature of the print head. Accordingly, when the circuit is connected to a device for producing input signals such as a microprocessor, and the print head elements are connected to the circuit through independently controllable switch means, the circuit can be effectively utilized for producing specified images of uniform darkness on a thermally responsive sheet. In addition, it will be understood that the circuit of the instant invention could also be used for controlling the energization of print head elements in response to other parameters than temperature. In any event, because of the relative simplicity of the circuit, it is effectively adapted for relatively inexpensive constructions which provides substantial economic advantages over the heretofore available circuits for energizing thermal print head elements.

Accordingly, it is a primary object of the instant invention to provide an economical circuit for controlling the energization of a plurality of print head elements on a thermal print head.

Another object of the instant invention is to provide a circuit for controlling the energization of a plurality of print head elements on a print head with sequential pulses, wherein the durations of the pulses are proportional to the temperature of the print head.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
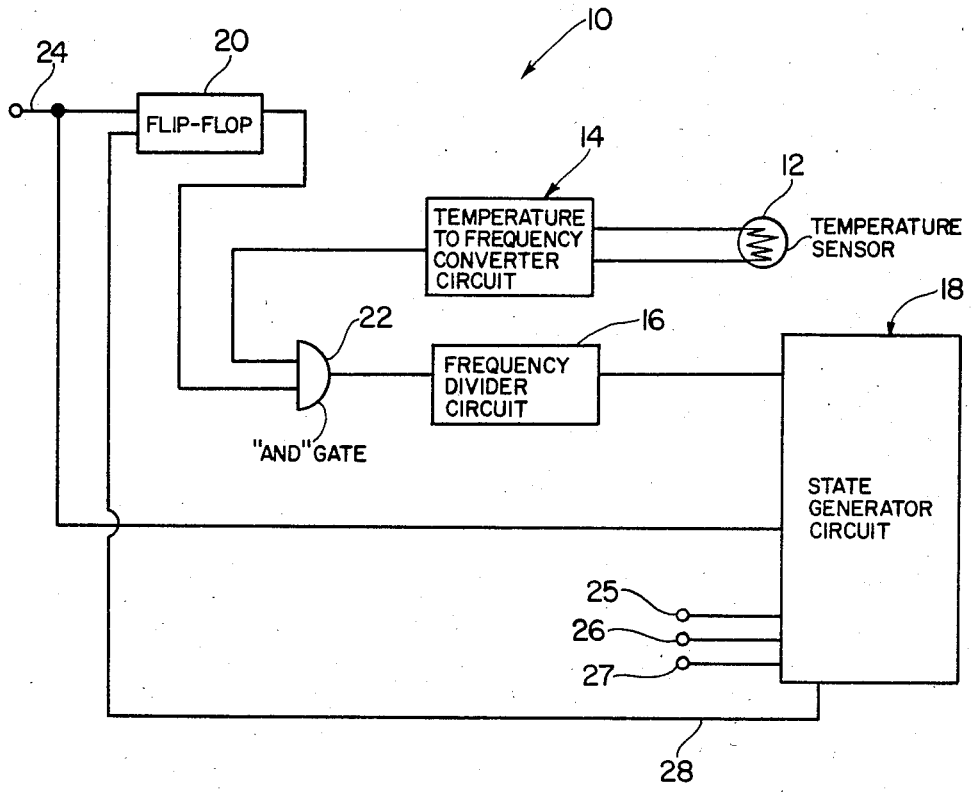
FIG. 1 is a block diagram of the circuit of the instant invention.
Figure 2:
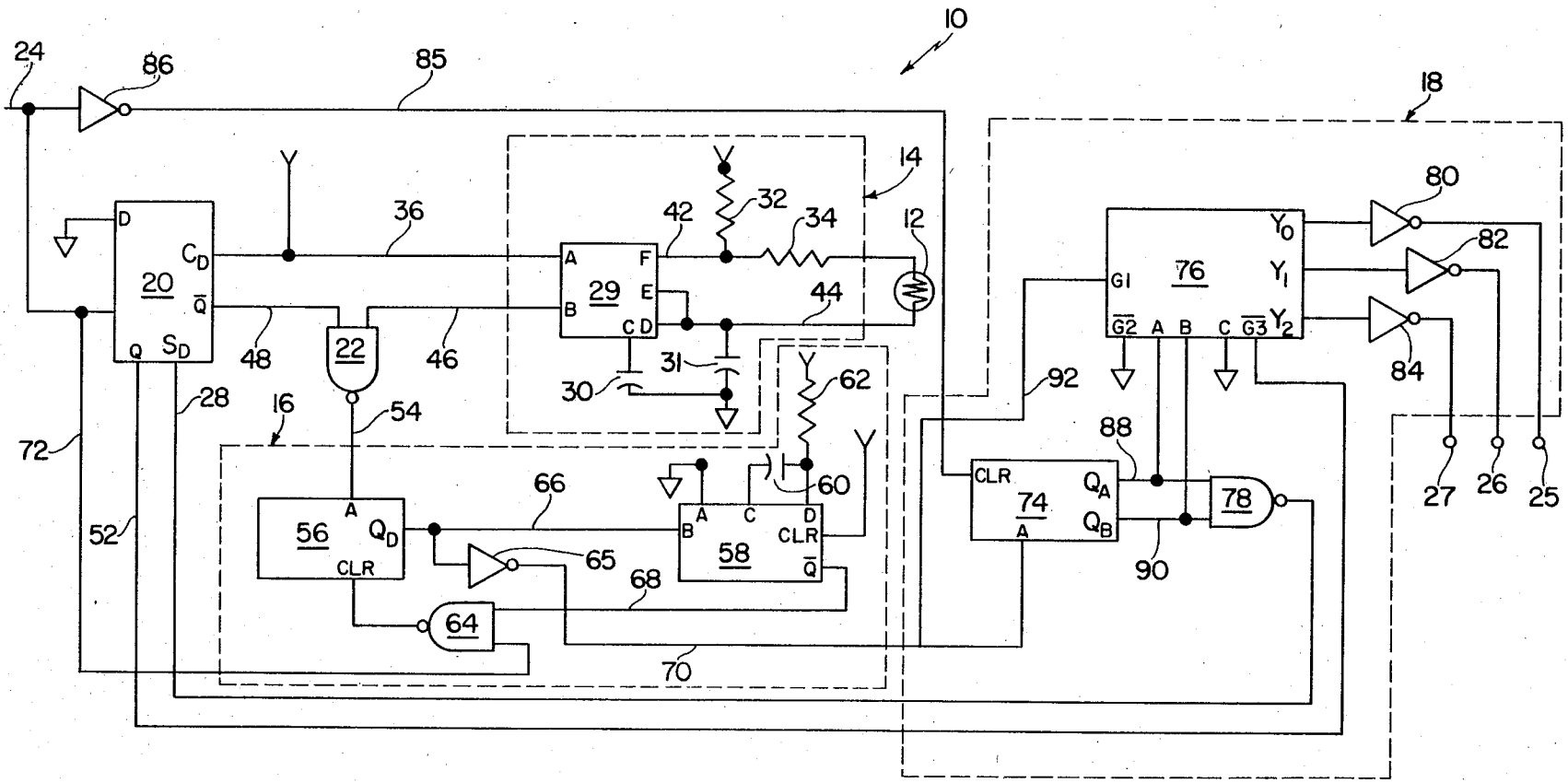
FIG. 2 is a schematic diagram of the circuit.

Referring now to the drawings, the electrical circuit of the instant invention is illustrated in FIGS. 1 and 2 and generally indicated at 10. The circuit 10 is actuatable in response to an input signal for producing a cycle of three sequential pulses of substantially uniform duration in order to sequentially control the energization of three different sets or groups of print head elements on a thermal print head at different times during the cycle for producing an image on a sheet of heat-sensitive material which is positioned adjacent the print head. In this regard, however, the circuit 10, which is preferably powered by a voltage source of approximately 5 volts, is responsive to the overall temperature of the print head for varying the durations of the pulses produced in different cycles in proportion to the temperature of the print head in order to provide a uniform darkness in the image produced on the sheet.

Referring first to FIG. 1, it will be seen that the circuit 10 comprises a temperature sensor 12, a temperature to frequency converter circuit generally indicated at 14, a frequency divider circuit generally indicated at 16, a state generator circuit generally indicated at 18, a flip-flop or bistable multivibrator generally indicated at 20, and an "AND" gate 22. The circuit 10 is operative whenever an input signal is received through an input line 24 for producing a cycle of sequential pulses of substantially identical duration in sequential output lines 25, 26 and 27, respectively, and for thereafter producing a change of state in the voltage in a stop line 32 so that no further pulses are emitted in the lines 25, 26, and 27 until another input signal is received by the circuit 10. In this regard, however, the circuit 10 is responsive to the temperature sensed by the sensor 12 for varying the durations of the pulses produced in different cycles without varying the voltage levels of the pulses so that as the temperature sensed by the sensor 12 increases, the durations of the pulses in the different cycles are reduced. It should be pointed out, however, that the temperatures actually sensed by the sensor 12 are effectively constant for each individual cycle due to the short durations of the cycles. Accordingly, when the lines 25, 26 and 27 are connected to gating or actuating circuitry for different groups of print head elements on a print head and the sensor 12 is mounted on the print head, the circuit 10 is operative for sequentially controlling the energization of the different groups of print head elements in a manner which permits the print head elements to produce an image of uniform darkness on a thermally sensitive sheet.

In operation of the circuit 10, the temperature to frequency converter circuit 14 continually produces a signal having a frequency which is proportional to the temperature sensed by the sensor 12. The "AND" gate 22 is connected to the temperature to frequency converter circuit 14 and also to the flip-flop 20, and it is operative for transmitting the signal from the temperature to frequency converter circuit 14 to the frequency divider circuit 16 whenever it also receives a signal from the flip-flop 20. When the flip-flop 20 receives an input signal from the input line 24, it sends a signal which is represented by a change in voltage state to the "AND" gate 22 and accordingly the "AND" gate 22 allows the signal from the temperature to frequency converter circuit 14 to pass to the frequency divider circuit 16. The frequency divider circuit 16 then produces a signal having a frequency which is also proportional to the temperature sensed by the sensor 12 but which is divided by a predetermined value relative to the signal produced by the temperature to frequency converter circuit 16. The divided signal from the frequency divider circuit 16 is then passed to the state generator circuit 18 which is operative for producing a cycle of sequential pulses or changes of state of short duration in the sequential lines 25, 26 and 27, respectively, and for then producing a change of state in the stop line 28. The duration of the pulses produced in the lines 25, 26, and 27 is, however, inversely proportional to the frequency of the signal from the frequency divider circuit 16 which is proportional to the temperature sensed by the sensor 12. Hence, when the output lines 25, 26, and 27 are connected to gating circuitry for different groups of thermal print head elements on a print head, the duration of the pulses received by the gating circuitry for the print head elements in different cycles are inversely proportional to the temperatures sensed by the sensor 12. However, after the third pulse in any one cycle has been produced from the state generator circuit 18, the circuit 18 produces a change in state as indicated by the stop line 28 so that the flip-flop 20 is changed to a deactuated condition wherein it no longer sends an actuating voltage state signal to the "AND" gate 22. As a result, only one pulse is produced in each of the lines 25, 26, and 27 for each input signal from the line 24.

Referring now to FIG. 2, the circuit 10 is illustrated in more detail. First, with regard to the temperature to frequency converter circuit 14, it will be seen that the circuit 14 comprises an astable multivibrator circuit comprising an I.C. timer 29, a filter capacitor 30, a timing capacitor 31, and a pair of resistors 32 and 34. The I.C. timer 29, which in the embodiment herein set forth, comprises a 555 timer, has an A Terminal which is interconnected through a line 36 to a positive voltage supply of the circuit 10 (approximately 5 volts), and an F Terminal which is interconnected to the positive voltage source through a line 42 and a resistor 32 and which is also interconnected to one terminal of the sensor 12 through a resistor 34. The sensor 12, which preferably comprises a thermistor, is interconnected to D and E Terminals of the timer 29 through a line 44. A C Terminal of the timer 29 is interconnected to ground through a filter capacitor 30 and the line 44 is interconnected to ground through a timing capacitor 31. The timer 29 also has a B Terminal which is interconnected to the gate 22 through an output line 46. In operation of the temperature to frequency converter circuit 14, a signal is produced in the output line 46 having a frequency which is proportional to the temperature sensed by the thermistor 12. In this regard, the resistors 32 and 34 and the thermistor 12 define a timing resistor network and the values of these components, along with the value of the timing capacitor 31 determine the frequency range of the signal which is produced in the output line 46. Preferably, the values of these components are selected to provide a frequency from the circuit 14 which is in the range of 10 KHz., although other embodiments of the circuit 14 which operate in different frequency ranges are contemplated. In this regard, however, as will hereinafter be made apparent, the frequency range of the signals produced by the circuit 14 must be coordinated with the frequency divider circuit 16 to produce signals from the frequency divider circuit 16 which have frequencies having cycle times or periods in the range of the desired durations of the pulses to be produced by the state generator circuit 18.

The flip-flop 20 comprises a bistable multivibrator, and it is connected to the input line 24 for receiving input signals therefrom. The flip-flop 20 has a clear or $C_D$ Terminal which is interconnected to the positive or high voltage source through the line 36 and a Q Terminal which is interconnected to the "AND" gate 22 through a line 48. In addition, the flip-flop 20 has an $S_D$ or set terminal which is interconnected to the state generator circuit 18 through the line 28 and a Q Terminal which is also interconnected to the state generator circuit 18. In the circuit 10 as herein embodied, the line 24 normally has a positive voltage level, and hence when initiating signals are received in the line 24, they are received in the form of pulses having reduced or zero voltage levels. During operation of the circuit 10, the flip-flop 20 is responsive to a low or zero voltage pulse in the input line 24 for emitting a pulse of reduced voltage to the "AND" gate 22 through the line 48.

The "AND" gate 22 actually comprises a "NAND" gate which is wired in the circuit 10 to function as an "AND" gate so that it operates in an actuated condition whenever it is receiving pulses from both the timer 26 and the flip-flop 20. Accordingly, since the timer 26 continually sends a signal to the "AND" gate 22, the "AND" gate 22 is actuated whenever it receives a signal in the form of a reduced voltage state through the line 48. When the "AND" gate 22 is in an actuated condition, the signals in the line 46 from the timer 29 are passed through the gate 22 to the frequency divider circuit 16 through an output line 54 connected to the "AND" gate 22.

The frequency divider circuit 16 is operative for dividing the frequency of the signal in the line 54 by a predetermined value and it comprises a first counter 56, a "one-shot" or monostable multivibrator 58, a timing capacitor 60, a timing resistor 62, and an "OR" gate 64. The "OR" gate 64 actually comprises a "NAND" gate which is connected in the circuit 10 so that it functions as an "OR" gate. The first counter 56 comprises a four bit binary counter which, in the embodiment herein set forth, is connected in the circuit 10 for dividing the frequency of the signal from the gate 22 by eight. The counter 56 has an A or input terminal which is connected to the line 54 for receiving signals from the gate 22, a clear terminal CLR which is connected to the gate 64, and a $Q_D$ terminal which is connected to the "one-shot" 58 through a line 66. The "one-shot" or monostable multivibrator 58 has an A Terminal which is connected to ground and a B Terminal to which the line 66 from the counter 56 is connected. A clear terminal CLR of the "one-shot" 58 is connected to the positive voltage source of the circuit 10 and a Q Terminal of the "one-shot" 58 is interconnected to the "OR" gate 64 through a line 68. The capacitor 60 is connected across C and D Terminals of the "one-shot" 58 and the D Terminal is connected to the resistor 62 which is connected to the positive voltage source of the circuit 10, whereby the resistor 62 and the capacitor 60 cooperate for controlling the duration of the pulses emitted by the "one-shot" 58. The line 66 between the counter 56 and the "one shot" 58 is also connected to the inverter 65 which is interconnected to the state generator circuit 18 through a line 70 as will hereinafter be more fully set forth, and the "OR" gate 64 is interconnected to the input line 24 through a line 72. In operation of the circuit 10, when an input signal in the form of a low voltage pulse is received in the line 24, the "OR" gate 64 emits a pulse having a reduced or zero voltage level to the clear terminal CLR of the counter 56 in order to initialize the counter 56 by setting it to a zero value. The counter 56 then emits a frequency divided signal through the terminal $Q_D$ thereof having a frequency which is one-eighth of the frequency of the signal received from the "AND" gate 22 through the line 54. This frequency divided signal from the first counter 56 is then transmitted through the line 66 to the "one-shot" 58 which emits a pulse to the "OR" gate 64 through the line 68 each time it receives a pulse from the first counter 56 so that the "one-shot" 58 operates for clearing or restarting the first counter 56 after each pulse emitted by the counter 56. In this regard, although the circuit of the instant invention could be constructed without the use of the one-shot 58 by connecting the output or $Q_D$ Terminal of the counter 56 to the line 68 so that the counter 56 would clear itself, in the preferred embodiment, the "one-shot" 58 is included for producing slight delays in the signals transmitted to the clear terminal CLR of the counter 56 to slightly increase the durations of the pulse emitted from the $Q_D$ Terminal of the counter 56 in order to stabilize the overall operation of the circuit 10. In any case, the output signal from the first counter 56 is inverted by the inverter 65 to produce a "state clock" signal in the line 70 which is defined by periods of reduced voltage in the otherwise high or circuit level voltage (approximately 5 volts) in the line 70.

The state generator circuit 18 comprises a second counter 74, a binary decoder 76, a "NAND" gate 78, and first, second, and third output inverters 80, 82, and 84, respectively. The counter 74 comprises a four bit binary counter which is similar to the counter 56 and which has an input terminal A, output terminals $Q_A$ and $Q_B$, and a clear terminal CLR. The input terminal A of the second counter 74 is connected to the line 70 for receiving the "state clock" signal from the frequency divider circuit 16 and the clear terminal CLR of the counter 74 is interconnected to the input line 24 through a line 85 and an inverter 86 for clearing or restarting the counter 74 whenever a new input signal is received by the circuit 10 through the line 24. The output terminals $Q_A$ and $Q_B$ of the counter 74 are connected to output lines 88 and 90, respectively, which are each individually connected to the binary decoder 76 and also to the "NAND" gate 78 and the "NAND" gate 78 is connected to the flip-flop 20 through the stop line 28. The binary decoder 76 preferably comprises a 74138 chip which is a one out of eight decoder or demultiplexer and it has enable terminals G1, G2 and G3, input terminals A, B, and C, and output terminals $Y_0$, $Y_1$, and $Y_2$. The G1 enable terminal of the decoder 76 is connected to the line 70 through a line 92 and it must be in a high voltage state in order for the decoder 76 to operate. Hence, the decoder 76 is rendered disabled during the low voltage "state clock" pulses in the line 70 from the frequency divider circuit 16. This avoids the possibility of undefined states during transitions from one state to another. The enable terminal G2 of the binary decoder 76 must be in a low voltage state for the decoder 76 to operate and it is connected to ground in the circuit 10 so that it is always in an enabling low voltage condition. The enable terminal G3 of the decoder 76 is interconnected to the Q terminal of the flip-flop 20 through the line 52, and it must also be in a low voltage condition to enable the decoder 76 to operate. In this regard, because the Q Terminal of the flip-flop 20 is normally in a low voltage condition except when a low voltage signal is being emitted from the Q Terminal of the flip-flop 20, the line 52 is normally in a low vltage condition whenever state generator circuit 18 is receiving signals from the frequency divider circuit 16 and hence, the enable terminal G3 is normally in an enabling condition unless there is a malfunction in the circuit 10 or in other circuitry connected thereto. The A and B input terminals of the decoder 76 are connected to the $Q_A$ and $Q_B$ output terminals of the counter 74, respectively, through the lines 88 and 90, respectively, and the C terminal of the decoder 76 is connected to ground so that it always has a low or zero voltage value. The output terminals $Y_0$, $Y_1$, and $Y_2$, of the decoder 76 are connected to the inverters 80, 82, and 84, respectively, which are connected to the output terminals 25, 26, and 27, respectively of the circuit 10.

Figure 3:
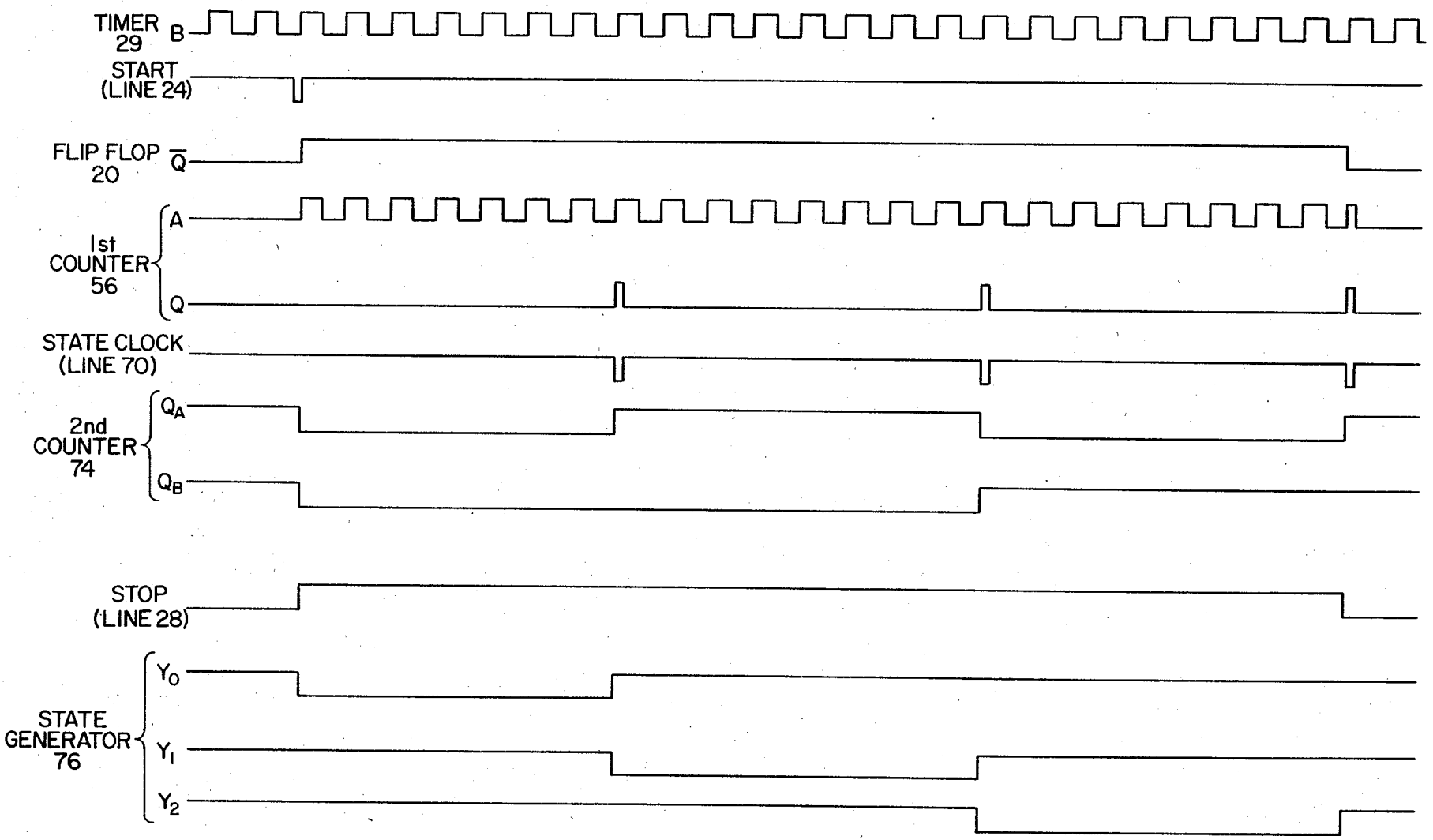
FIG. 3 is a timing diagram of the circuit.

As illustrated in FIG. 3, during the operation of the circuit 10, when a start signal is received through the line 24, this signal is transmitted to the counter 74 through the line 85 so that the counter 74 is initially cleared and thereafter the counter 74 receives a series of "state clock" signals from the frequency divider circuit 16 through the line 70 until one complete cycle of signals has been produced in the output terminals 25, 26 and 27. In order to produce a cycle of sequential pulses, binary signals are transmitted from the counter 74 to the decoder 76 through the lines 88 and 90. More specifically, when the counter 74 is cleared, it sets the voltages in the lines 88 and 90 to low or zero levels, and when the first state clock signal is received by the counter 74 through the line 70, the voltage in the line 88 is changed to a high voltage state. Thereafter, when the second "state clock" pulse is received by the counter 74, the voltage in the line 88 is changed to a low voltage state and when the third pulse is received, the voltage in the line 88 is changed back to a high state. In addition, when the second "state clock" signal is received by the counter 74, the counter 74 also operates to change the voltage in the line 90 from a low or zero voltage state to a high voltage state. The binary decoder 76 reads the signals in the lines 88 and 90 from the second counter 74 as having zero values when they are in zero or low voltage states and values of one when they are in high voltage states, and it interprets them in a binary format for emitting sequential pulses of substantially identical duration from the terminals $Y_0$, $Y_1$, and $Y_2$. More specifically, during the initial portion of a cycle when the voltage levels in the lines 88 and 90 are both low or zero, terminals A and B of the decoder 76 are both interpreted as having zero values, and therefore the decoder 76 maintains the first output terminal $Y_0$ in a low voltage state and the terminals $Y_1$ and $Y_2$ in high voltage states. These voltage states are inverted by their respective inverters 80, 82, and 84, respectively, to provide opposite values at the terminals 25, 26, and 27 to make the circuit 10 more compatible with conventional print head circuitry. When the first "state clock" pulse is received by the counter 74, the voltage level in the output terminal $Q_A$ thereof is changed to a high value so that the terminal A of the binary decoder is interpreted as having a value of 1, whereas the value of the voltage at the terminal $Q_B$ of the counter 74 remains low or zero so that the terminal B of the decoder 76 still has a zero value. When the decoder 76 is in this condition, the terminal $Y_0$ is changed back to a high voltage state, the terminal $Y_1$ is changed to a low or zero voltage state, the terminal $Y_2$ remains in a high volume state and the values of the voltages at the terminals $Y_0$, $Y_1$, and $Y_2$ are again inverted by their respective inverters to provide opposite values at the terminals 25, 26, and 27. Thereafter, when the second "state clock" pulse is received by the counter 74 through the line 70, the voltage level at the terminal $Q_A$ of the counter 74 is returned to a zero value and the voltage level at the terminal B is changed to a high condition. Accordingly, the decoder 76 interprets the signals at the terminals A and B thereof as having values of zero and one, respectively. When the decoder 76 is in this condition, the terminal $Y_1$ is changed back to a high voltage state so that the terminals $Y_0$ and $Y_1$ both have high voltage levels, and the $Y_2$ terminal is changed to a low or zero voltage state and the values at the terminals $Y_0$, $Y_1$, and $Y_2$ are again inverted by their respective inverters to provide opposite values at the terminals 25, 26, and 27. Finally, when a third state clock pulse is received by the counter 74 through the line 70, the voltage level at the terminal $Q_B$ remains high, whereas the voltage level in the terminal $Q_A$ changes from a low or zero voltage state to a high voltage state. Accordingly, the decoder 76 interprets the voltage levels at both terminals A and B thereof as having values of one and it changes the voltage at the $Y_2$ Terminal back to a high state whereas the voltages at the $Y_0$ and $Y_1$ Terminals remain high. Further, when the voltages in the lines 88 and 90 are both high, the "NAND" gate 78 changes the voltage level in the stop line 28 to a low or zero voltage state which causes the flip-flop 20 to deactuate the circuit 10. As a result, after three sequential pulses have been emitted from the sequential terminals $Y_0$, $Y_1$, and $Y_2$ of the decoder 76, the circuit 10 is deactuated until a further input signal is received in the line 24.

In operation of the circuit 10, the thermistor 12 is operative for sensing the temperature of a print head, and the temperature to frequency converter circuit 14 is operative for producing a signal in the line 46 having a frequency which is proportional to the temperature sensed by the thermistor 12. Whenever a low voltage input signal is received in the line 24, the flip-flop 20 emits a low voltage signal to the "AND" gate 22 whereby the signal in the line 46 from the temperature to frequency converter circuit 14 is transmitted to the frequency divider circuit 16 through the line 54. The frequency divider circuit 16 then divides the frequency of the signal from the "AND" gate 22 by eight and it emits a frequency divided "state clock" signal in the line 70. The state generator circuit 18 receives the "state clock" pulses from the line 70, and it emits three sequential pulses of substantially identical duration at the terminals 25, 26, and 27. In this regard, since the state generator circuit 18 changes state each time a "state clock" pulse is received through the line 70, the duration of the pulses emitted from the state generator circuit 18 during a single cycle is equal to the period between the sequential "state clock" pulses in the cycle, and therefore the duration of the signals emitted from the state clock circuit 18 is also proportional to the frequency of the signals emitted from the temperature to frequency converter circuit 14.

It is seen therefore that the instant invention provides an effective electrical circuit for controlling the energization of thermal print head elements on a thermal print head. Whenever a signal is received in the input line 24, the circuit 10 emits a series of three sequential pulses in the output terminals 25, 26, and 27 which are operable for actuating the energizations of three sequential groups of print head elements on the print head. However, since the duration of the pulses emitted from the terminals 25, 26, and 27 is proportional to the temperature sensed by the temperature sensor 12, the amount of energy supplied to the print head elements can be reduced as the overall temperature of the print head is increased. As a result, the circuit 10 can be effectively utilized for energizing the print head elements of a thermal print head to produce clear images of substantially uniform darkness, regardless of the overall print head temperature. Further, the problem of burning the thermally sensitive sheet with the print head is avoided. Accordingly, it is seen that for these reasons as well as the other reasons hereinabove set forth, that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A circuit for controlling the energization of a plurality of thermal print head elements on a thermal print head comprising:

a. means for sensing the temperature of said head;

b. first signal generating means responsive to said temperature sensing means for generating an electrical signal having a frequency which is proportional to the temperature of said head;

c. second signal generating means communicating with said first signal generating means and actuatable for generating a predetermined number of sequential output pulses of substantially uniform duration during a period of time wherein the temperature of said head remains substantially constant and wherein said duration is substantially proportional to the frequency of said first signal generating means, said second signal generating means communicating with said print head elements for sequentially controlling the energization of different print head elements with sequential pulses; and d. means for actuating said second signal generating means in response to an input signal to said circuit and for automatically deactuating said second signal generating means after said predetermined number of sequential pulses has been produced therefrom, said means for actuating and deactuating comprising a bistable multivibrator and gate means, said first signal generating means communicating with said second signal generating means through said gate means, said bistable multivibrator being responsive to an input signal to said circuit for actuating said gate means to provide said communication between said first signal generating means and said second signal generating means.

2. A circuit for controlling the energization of a plurality of thermal print head elements on a thermal print head comprising:

a. means for sensing the temperature of said head;

b. first signal generating means responsive to said temperature sensing means for generating an electrical signal having a frequency which is proportional to the temperature of said head;

c. second signal generating means communicating with said first signal generating means and actuatable for generating a predetermined number of sequential output pulses of substantially uniform duration during a period of time wherein the temperature of said head remains substantially constant and wherein said duration is substantially proportional to the frequency of said first signal generating means, said second signal generating means communicating with said print head elements for sequentially controlling the energization of different print head elements with sequential pulses, said second signal generating means comprising counter means, and decoder means, said counter means communicating with said first signal generating means for producing sequential binary signals at intervals which are proportional to the frequency of said first signal generating means signal, said decoder means communicating with said counter means for producing a different one of said sequential output signals in response to each of said sequential binary signals until said predetermined number of sequential output signals has been produced and for thereafter producing a deactuating signal; and d. means for actuating said second signal generating means in response to an input signal to said circuit and for communicating with said decoder means to automatically deactuate second signal generating means in response to said deactuating signal.

* * * * *